US005205092A

United States Patent [19]

Taylor

[11] Patent Number: 5,205,092

[45] Date of Patent: Apr. 27, 1993

[54] THRESHOLD MAT

[75] Inventor: Brian J. Taylor, Faversham, United Kingdom

[73] Assignee: PSA Threshold Limited, United Kingdom

[21] Appl. No.: 916,204

[22] Filed: Jul. 17, 1992

[30] Foreign Application Priority Data

Jul. 18, 1991 [GB] United Kingdom ..... 9115514

[51] Int. Cl.[5] ..... A47L 23/26

[52] U.S. Cl. ..... 52/177; 52/181; 52/584; 15/215; 15/216; 15/217; 428/53; 428/54

[58] Field of Search ..... 52/177, 181, 584, 464, 52/468, 772, 775, 779; 15/215, 216, 217, 161; 160/231.1; 428/53, 54

[56] References Cited

U.S. PATENT DOCUMENTS

| | | | |
|---|---|---|---|
| 2,388,297 | 11/1945 | Slaughter | 428/53 |
| 3,530,633 | 9/1970 | Scott | 52/584 X |
| 4,029,834 | 6/1977 | Bartlett | 15/215 X |
| 4,381,324 | 4/1983 | Ellingston, Jr. | 428/53 X |
| 4,408,365 | 11/1983 | Palmer | 15/216 X |
| 4,654,245 | 3/1987 | Balzer et al. | 428/53 X |
| 4,675,222 | 6/1987 | Berndt, Jr. | 428/53 |
| 4,804,570 | 2/1989 | Bedic | 15/217 X |
| 4,879,151 | 11/1989 | Ellingson, Jr. | 15/215 X |
| 4,891,920 | 1/1990 | Pingston | 52/464 X |
| 4,952,434 | 8/1990 | Rumsey et al. | 15/215 X |
| 5,157,804 | 10/1992 | Williams | 52/177 X |

FOREIGN PATENT DOCUMENTS 3210042 9/1983 Fed. Rep. of Germany .

*Primary Examiner*—Carl D. Friedman
*Assistant Examiner*—Robert Canfield
*Attorney, Agent, or Firm*—Ostrolenk, Faber, Gerb & Soffen

[57] ABSTRACT

A threshold mat comprising alternating scraper units and wiper units. The improvement is that the wipers, that is strips of carpeting are carried on extrusion carriers and are gripped by their edges via a tightenable clamp incorporated in the scraper unit. The feature of tightening enables different thicknesses of carpet material to be accommodated.

5 Claims, 2 Drawing Sheets

THRESHOLD MAT

The present invention relates to threshold mats particularly for use at the entrances to buildings where the mat has as it primary purpose to remove dirt and moisture from the foot wear of people entering the building.

Various prior art threshold mats are known consisting of parallel strips, of which alternate strips are scrapers and wipers. The invention is particularly concerned with entrance mats where the wiper strips are essentially in the form of lengths of carpet or other suitable wiper material, e.g. shaped rubber.

It is desirable in such an arrangement that the construction enables different forms of carpeting to be used dependent on required technical performance, cost, and appearance required by the customer. In general, where different forms of carpeting are needed, ti may well be that due to that different thickness a different construction from the start has to be used, is the whole unit has to be designed with a particular form of carpeting in mind, and the unit can only accommodate one thickness. The present invention therefore is concerned with solving this problem. Thus, the invention is concerned with the problem of providing a single construction which can be used despite the fact that the carpeting or other wiper material may be of differing thickness for different customer requirements.

Accordingly the invention provides a threshold mat formed from wiper and scraper units linked together as alternating strips, each wiper unit being in the form of an extrusion carrier carrying a length of wiper material, and each scraper unit being in the form of separable components which are each linked to an adjacent wiper unit by a tightenable clamp which enables the unit to grip the edge of the adjacent wiper material and to accommodate wiper materials of differing thickness.

Preferably the tightenable clamp is a nut end bolt arrangement which can be tightened from below the mat.

A preferred arrangement for each scraper unit is to have an upper scraper member, and a lower linking member, the members being tightened together in use to grip the adjacent wiper unit. Then below the linking member a base support member can conveniently be provided.

Each extrusion carrier of the wiper unit preferably has a lateral edge feature which links with the linking member of the scraper unit to hold the scraper and wiper units together.

This lateral edge feature may be defined within the extrusion as a re-entrant open channel at each side edge of the extrusion carrier and the linking member of the scraper unit may include a protruding T-shaped element which is gripped by the re-entrant open channel.

An embodiment of the invention will now be described by way of example with reference to the accompanying diagrammatic drawings in which FIG. 1 is a part broken away perspective view of a mat; and FIG. 2 shows a sectional view of the clamping arrangement.

Figure 1:
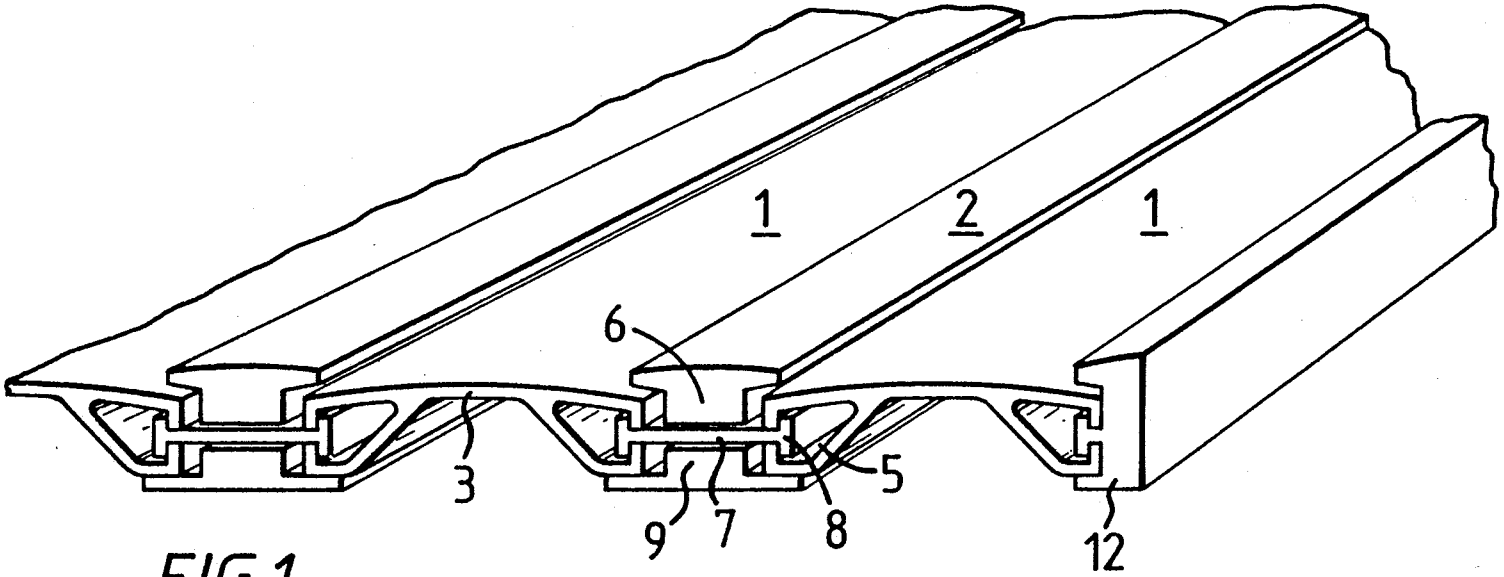

Referring to FIG. 1, a number of wiper units (1) alternate with scraper units (2). Each wiper unit (1) is in the form of an extrusion carrier (3) carrying on its upper surface a strip of a suitable infill material (4) such as carpeting (see FIG. 2). The extrusion carrier is of a shape which is slightly convex on its upper surface and defines at each of its edges a re-entrant open channel (5). Being re-entrant, means that the channel defines a pair of pincer like lips which can then retain an element within that channel. The scraper unit (2) consists essentially of three components of which the first is an upper scraper member (6) of a hard suitable material which presents this hard upper surface as a wearing surface to the user end thereof forms a scraper. The unit also comprises a lower linking member (7) which as well as extending longitudinally with the upper element, extends laterally and each lateral extension has an outwardly enlarged end by being in the shape of a T in cross section. Each extending T-shaped protrusion (8) can then be gripped within the re-entrant lips of the re-entrant channel (5).

The third component of the scraper unit is a base member (9), of which a series will be provided along each strip.

Figure 2:
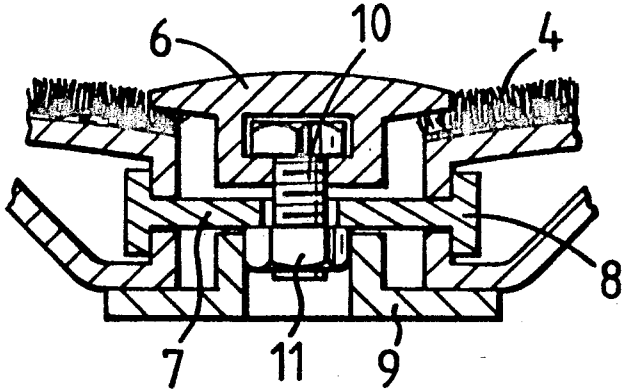

Referring to the FIG. 2, the upper scraper member (6) and the linking member (7) each has, at intervals along its length, a clamping bolt (10) and nut (11). The stem of the bolt (10) passes through a hole in each linking member (7) and the nut is tightened to a pre-determined torque to cause the edge of the scraper member (6) to grip the edge of the infill strip (4) against the extrusion channel (5) and linking member T-shaped protrusion (8).

Each base member (9), one for each nut/bolt, is snapped on to a respective nut (11). The whole unit consisting of a number of parallel wiper and scraper strips is then enclosed by end caps (12) and side cap sections. The end caps are effectively half of a scraper unit in section so that groups of strips can be assembled together to make up a larger unit if desired.

In practice the materials to be used will depend on the working requirements. The extruded channel (3) may be of aluminum while the wiper unit may be a carpeting material or rubber or similar material. The scraper unit upper member (6) may be any suitable material such as aluminum or brass or colored hard PVC, while the linking member (7) is conveniently polypropylene. The base member (9) is preferably rubber.

Figure 3:
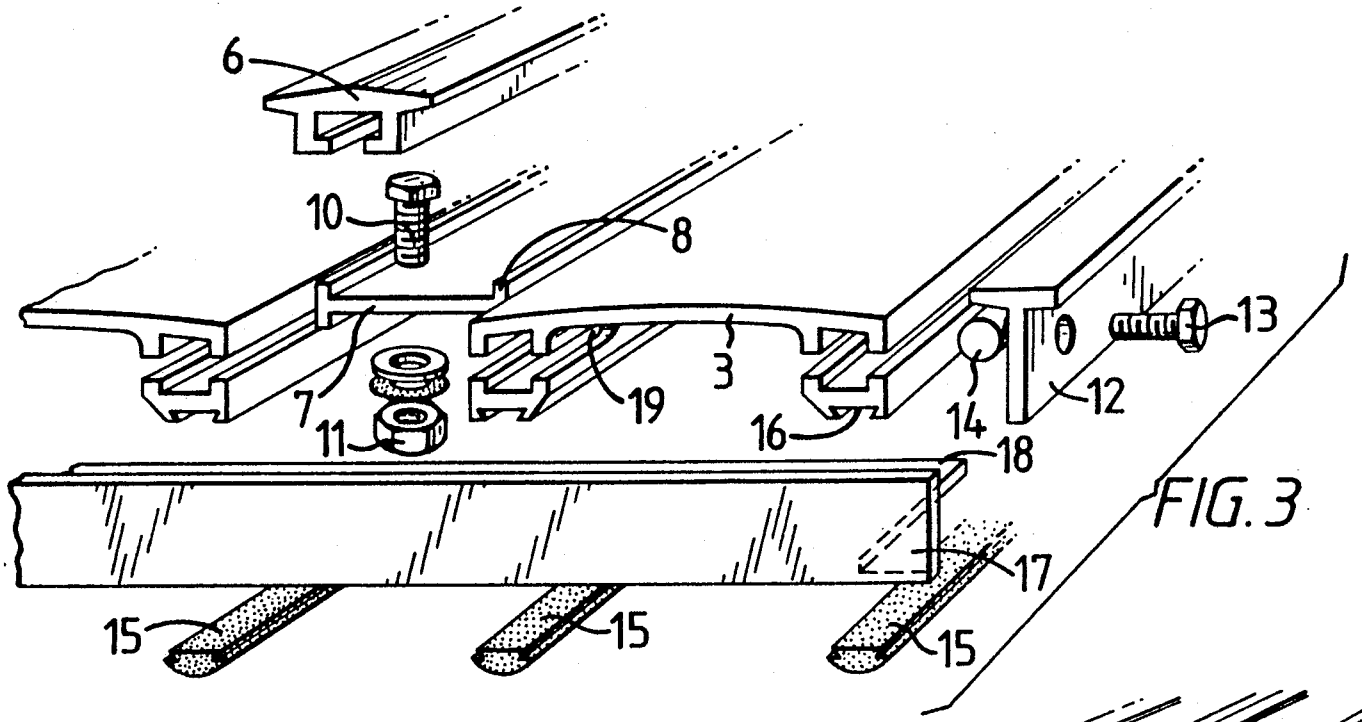
FIG. 3 shows an exploded view of an improved version.
Figure 4:
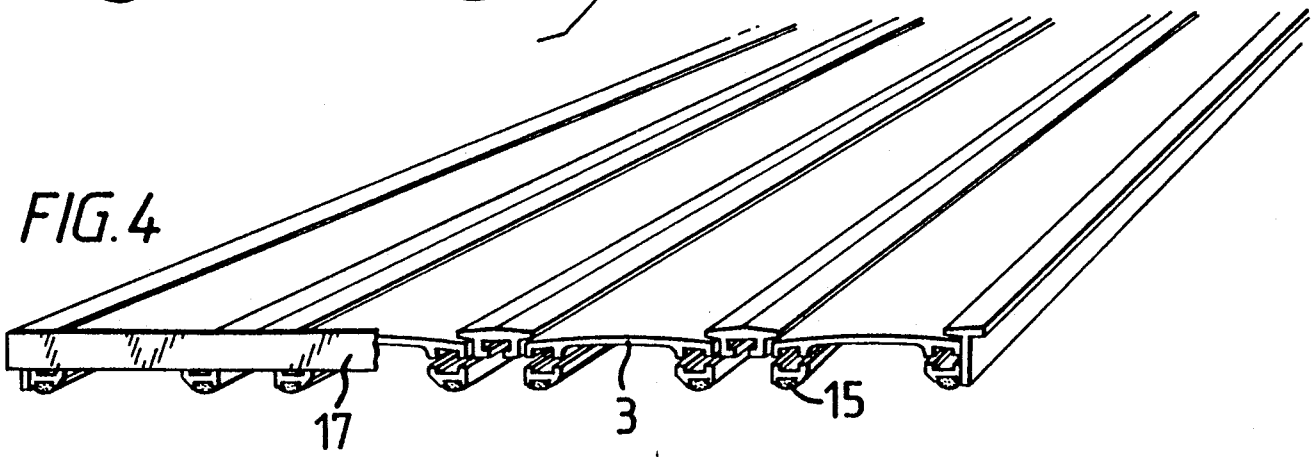
FIG. 4 is a perspective view part broken away of this version.

A more developed version of the invention is shown in an exploded view in FIG. 3. There are three essential changes:

i) the end caps (12) are not attached by bolts (13) passing through the caps into threaded apertures in a longitudinal toggle bush (14).

ii) the base members (9) have been replaced by longitudinal rubber extension (15) which are held captive within keyways (16) on the lower side of each extrusion carrier (3).

iii) side caps (17) in the form of stretcher bars are provided. Each of these has a protruding tongue (18), so that the stretcher bar is an L or T shaped extrusion, are gripped by the tightened scraper member (6), via tightening of the nuts 11 and bolts (10) which being accommodated in the external slots of the wiper units (1). The slots are made laterally continuous at their edges by provision of cut-outs (19).

The effect then of the stretcher bars is to define a rigid rectangular framework with the end caps (12) which encloses the overall matting arrangement in a structurally firm and protective manner.

I claim:

1. A threshold mat comprising alternate wipe and scraper units linked together at adjacent edges as alternating strips, each wiper unit being in the form of an extrusion carrier carrying a length of wiper material, and each scraper unit being in the form of separable components, said mat further comprising linking means for linking adjacent wiper and scraper units which includes a tightenable clamp which enables each scraper unit to grip an edge of the adjacent wiper material and to accommodate wiper materials of differing thickness.

2. A threshold mat according to claim 1 in which the tightenable clamp is a nut and bolt arrangement which can be tightened from below the mat.

3. A threshold mat according to claim 1 in which each extrusion carrier of the wiper unit has a lateral edge feature which links via the linking means with the scraper unit to hold the scraper and wiper units together.

4. A threshold mat according to claim 3 in which said lateral edge features is in the form of a re-entrant open channel at each side of the extrusion carrier and the linking means includes a protruding shaped element having an outwardly enlarged end which is gripped by the re-entrant open channel.

5. A threshold mat according to claim 3, comprising lateral end caps each attached to a lateral edge feature of an outer respective extrusion carrier.

* * * * *